United States Patent [19]

Kalous

[11] Patent Number: 4,787,523

[45] Date of Patent: Nov. 29, 1988

[54] TEST TUBE RACK

[76] Inventor: Leo D. Kalous, 12 Tyler St., Newport, R.I. 02840

[21] Appl. No.: 70,335

[22] Filed: Jul. 6, 1987

[51] Int. Cl.[4] ..... A47B 73/00

[52] U.S. Cl. ..... 211/74; 211/76

[58] Field of Search ..... 211/74, 4, 76, 71; 422/99, 119, 44, 310; 220/102

[56] References Cited

U.S. PATENT DOCUMENTS 372,222 10/1887 Hudson ..... 211/74
806,819 12/1905 Maltson ..... 211/74
2,956,687 10/1960 Robichaud ..... 211/74
3,109,084 10/1963 Walsh ..... 211/74 X

*Primary Examiner*—Reinaldo P. Machado
*Assistant Examiner*—Sarah A. Lechok Eley
*Attorney, Agent, or Firm*—Robert J. Doherty

[57] ABSTRACT

A test tube rack for both group stamping and thereafter holding reagent tubes in test position. The rack includes end supports and an intermediate test tube grid and is operable in alternate horizontal position for the stamping operations and in a vertical position for the test operation. Control bars with means for holding specimen tubes may also operate to hold the reagent tubes in position. The control bars also operate in open and closed positions.

20 Claims, 2 Drawing Sheets

TEST TUBE RACK

This invention relates to a test tube rack or holder for enabling test tubes to be both quickly identified by the group stamping of indicia thereon and for upright support in a use position either alone or adjacent to test specimens. Presently these operations are carried out separately using common utilized test tube racks or by using overly complex and expensive electro-mechanical devices. Such commonly practiced preparatory and sampling techniques with conventional test tube racks includes the initial spreading of the test tube upon a counter top. Thereafter with a marking pen, an identification mark is written on the tube. Each tube is then picked up and placed into a test tube rack. A sample specimen is then placed in a separate test tube rack. The operator then using one hand to hold a pipette and the other hand to take the test tube out of the rack, transfers the patient specimen sample from the specimen tube into the reaction tube. Thereafter the finished tubes are placed back into the proper rack. After such, the operator transfers the reaction tubes with the sample into a different test tube rack and thereafter picks up each tube one by one and pipettes the samples therein using a standard repeating pipette. The mixture in the reaction tubes is then incubated and separated, if needed, by picking each tube out of the rack and inverting it. This often necessitates blotting of the top of the test tube with an absorbent towel. Thereafter any additional reagents are added by picking each tube out of the test tube rack. The test tubes are then transferred one by one into racks to be measured if necessary by a measuring device such as a gamma counter. Finally each tube is reviewed by observing the contents thereof and/or after quantitation of its contents has been made.

All or at least a major portion of the above steps are considered common practice in performing analysis utilizing disposable test tubes. As one can readily see, such involves a number of additive and relatively complex handling tasks which it would be desirable to eliminate or reduce without the need of expensive and complex electro-mechanical devices.

The primary object of the present invention is to provide a device which, accordingly, enables a great many of the commonly utilized steps in preparing and reacting test tube samples to be combined, eliminated, or simplified.

A further object of the present invention is to provide such a device which is simple, inexpensive yet easy to operate and which requires almost no training time for a knowledgeable technician.

These and other objects of the present invention are accomplished by a test tube rack usable in alternate horizontal and vertical use positions for respectively initially loading and stamping reaction tubes and thereafter conducting tests from patient specimen tubes in such reaction tubes comprising a rack body including a pair of end plates each having a lower edge surface for supporting the rack in its vertical position and at least one adjacent side edge surface for supporting said rack in its alternate horizontal position wherein said body further includes a substantially planar tube grid with upper and lower surfaces and longitudinally extending between said end plates and supported thereby, said grid having at least one surface provided with a plurality of upstanding, aligned, and longitudinally spaced members for supporting and longitudinally spacing a plurality of reagent test tubes thereon and at least one control bar longitudinally extending along said one grid surface and operable between open and closed alternate positions, said control bar having an inner surface terminating in a longitudinal edge proximally spaced in opposition to said one grid surface and adapted to contact said reagent test tubes supported thereon in its closed position and positioned away from said one grid surface in its open position, said closed control bar position adapted for use in said vertical rack position to lock said reagent tubes in an upright position.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DETAILED DESCRIPTION OF THE INVENTION

Figure 1:
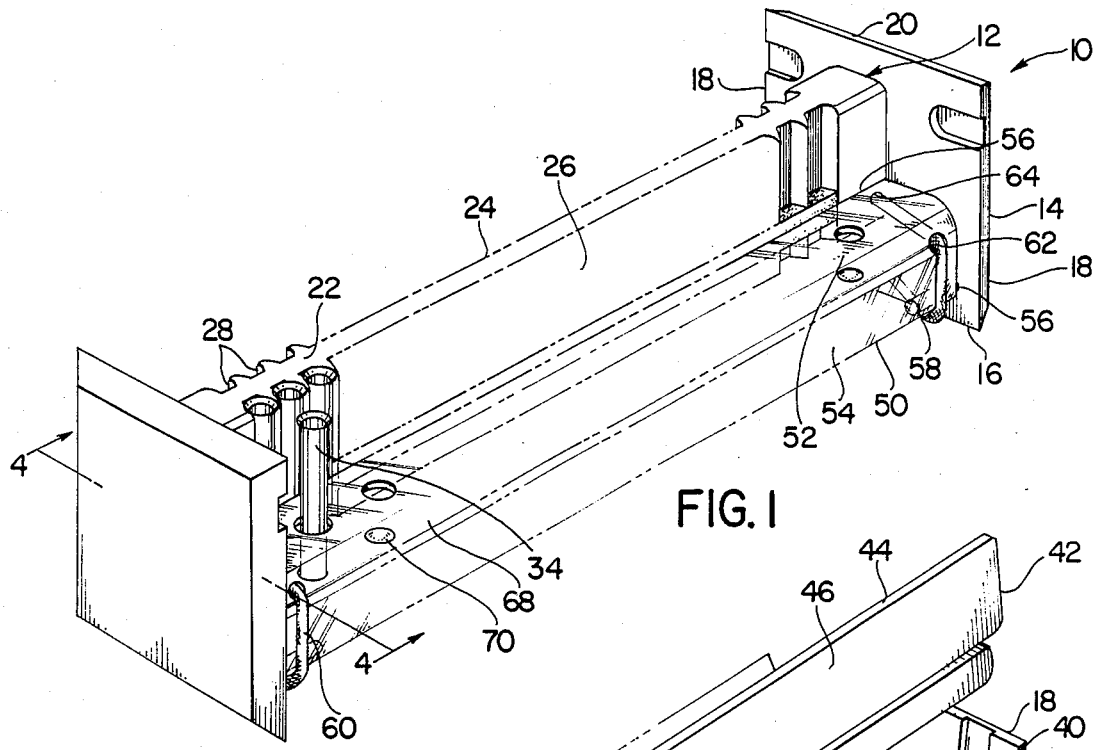
FIG. 1 is a perspective view of the test tube rack of the present invention shown in an upright position as would be utilized in conducting specimen testing.
Figure 2:
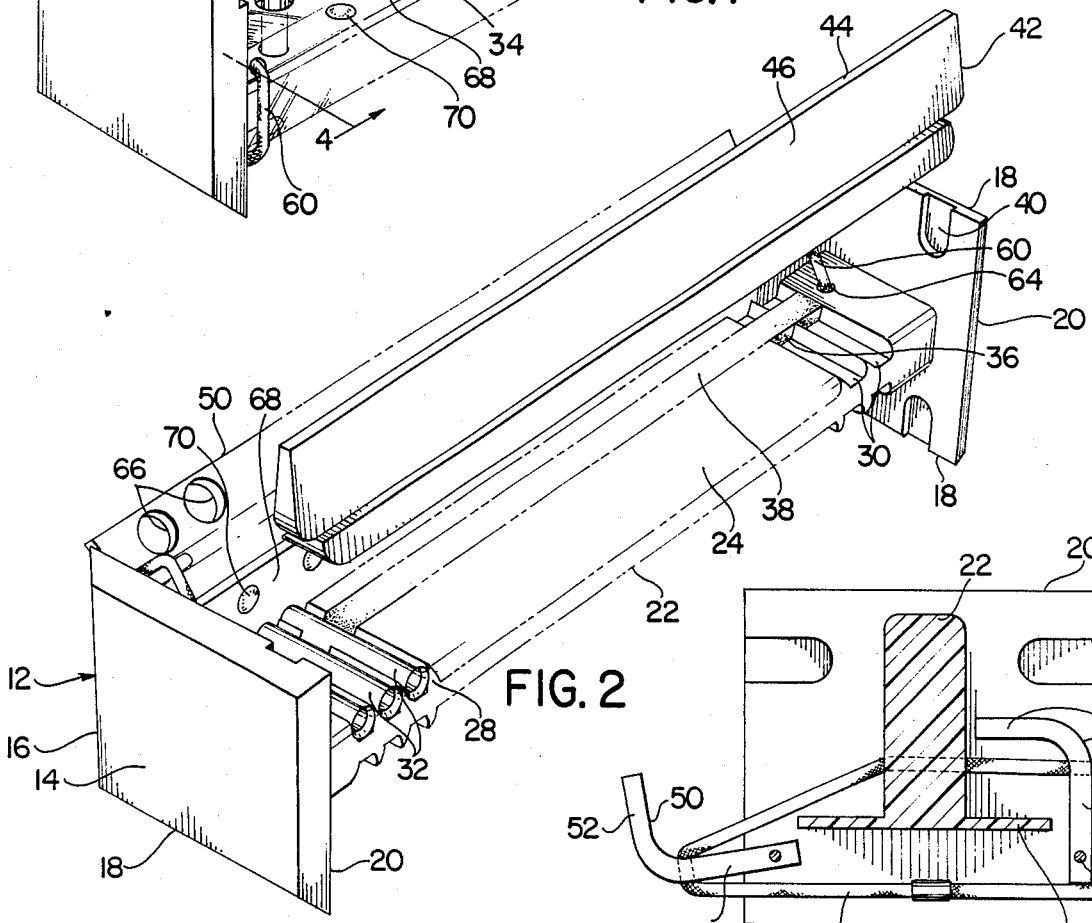
FIG. 2 is a view of the test tube rack of the present invention disposed in one of its alternate horizontal positions showing the manner in which reagent test tubes may be positioned thereon and group stamped with identifying indicia.

Turning now to the drawings and more particularly FIGS. 1 and 2, the overall construction of the test rack 10 is depicted. The rack 10 includes a body 12 further including a pair of end plates 14 each in turn having a lower edge surface 16 and a pair of opposed side edge surfaces 18 adjacent thereto. A top edge surface 20 is disposed opposite to lower edge surface 16. As best shown by FIG. 1, the rack 10 is shown disposed in its upright vertical position when supported on edge surfaces 16 of the end plate pairs 14 and as best shown in FIG. 2 in its horizontal position when supported upon either of the edge surfaces 18 thereof. In that way then, there are two alternate horizontal positions, i.e., a first and a second horizontal position, and a single upright position, there being no distinct use position in the upright inverted position as when the rack is supported on the top edge surfaces 20 except for the possibility of draining a plurality of reagent test tubes held therein as with hereinafter be more fully explained.

The body 12 further includes a substantially planar tube grid 22 having an upper surface 24 and a lower surface 26. Each such surface 24, 26 of the grid 22 is provided with a plurality of upstanding generally V-shaped spacer members 28. Such members are parallel to each other and longitudinally spaced such that they provide pockets 30 for the receipt of reagent tubes 32. Any suitable number of pockets 30 are provided although normally there is an even number of such pockets inasmuch as most specimen testing is done in duplicate thus requiring two reagent tubes 32 for each specimen tube 34. The support of the specimen tubes 34 in position adjacent to the reagent tubes will be hereinafter discussed. The dotted line representation in both FIGS. 1 and 2 represents the provision of any desired number of such pockets 30.

The upright members 28 are further preferably cut away towards the lower edge of the grid 24 so as to form a longitudinal slot 36 in which a strip of resilient cushioning material such as foam rubber is placed such that a resilient support is given to the reagent tubes 32 placed in the pockets 30. It should also be pointed out that pairs of parallel slots 40 are disposed in the surfaces of the end plates 14 proximal the grid 24 such that the opposed ends 42 of an elongated stamping member 44 may be disposed therein.

The stamping member 44 includes a gripable body portion 46 and a lower surface 48 including a rubber insert 49 containing the indicia desired to be ink stamped upon the reagent tubes 32. Thus by aligning the stamp pad 44 in the opposed slots 40, the reagent tubes 32 disposed in the pockets 30 may be simultaneously stamped thus saving time and avoiding errors. Normally when the rack 10 is placed in the horizontal position shown in FIG. 2, a quantity of reagent tubes 32 can simply be gathered up in one's hand and rolled along the upper surface 24 of the grid such that one is positioned in each of the pockets 30. In this preliminary step it should be pointed out that a control bar 50 is disposed in its open position.

Such control bar 50 and as best depicted in FIG. 1 of the drawing, is preferably formed of a transparent plastic material such as Lucite and is of elongated generally L-shaped cross-sectional configuration and having an upper surface 52 and a lower surface 54. The upper surface 52 terminates in an inner edge surface 56 which in its closed position as shown in FIG. 1 is adapted to contact upper surfaces of the reagent tubes 32 and press them into a tight resilient engagement with the resilient strip 38 such that they are held snugly yet gently within the pockets 30. The configuration and width of the upper surface 52 is such that the edge 56 in the closed position is disposed approximately above the elongated slot 36.

Such control bar 50 is disposed for pivotal movement with respect to the end plates 14 by means of a pair of pins 57 inwardly extending from the end plates 14 and mounted into longitudinal openings 58 provided in the lower surface 54 of the control bars. It should be noted that there is a control bar on each side such that both grid surfaces 24 and 26 may be similarly utilized and that the control bar 50 is resiliently urged to both its open and closed position by a resilient cord 60 which encircles the lower surface of the control bar 54 and extends through a pair of openings 62 provided therein and thence through an opening 64 provided through the grid. In this way then, the elastic cords 60 serve to urge the control bar against the grid surfaces 24, 26 in its closed position as shown in FIG. 1. It similarly holds the control bar 50 in its open position as shown in FIG. 2.

Normally after the reagent tubes 32 are positioned in the pockets 30, the control bar 50 is placed in its closed position, the tubes 32 thereafter stamped by the stamper pad 44, and then the unit placed in its upright position. Thereafter the specimen tubes 34 are placed within openings 66 provided in the top surface 52 of the control bar 50. In addition, the grid 22 includes a pair of shelves 68 outwardly extending from each surface 24, 26 and upon which the bottoms of the tubes 34 may rest. Such shelves may also include depressions 70 to further assist in positioning the tubes 34. In this way then, the specimen tubes 34 are positioned in close proximity and adjacent a pair of reagent tubes 32 in such a manner that repeating pipette testing is facilitated. Normally the operator in this position takes a specimen sample from the tube 34 and places it in one of the reagent tubes 32. Thereafter if a duplicate test is to be made, the process is merely repeated. When all the specimen tests have been conducted and the incubation and decanting quantitative analysis performed thereon or whatever other steps may be necessary, all the specimen tubes may be disposed of merely by inverting the rack and dumping them into a disposal receptacle Thereafter the reagent tubes 3 may be blotted if desired en masse, and the entire testing program repeated.

It should also be pointed out that it is normal for both sides of the grid 22 to be loaded with reagent tubes, it being clear that once one side is loaded and the respective control bar 50 placed in the closed position, that the rack 10 is then disposed on the opposite edge surface 18 such that the process can be repeated on the other grid surface.

Figure 5:
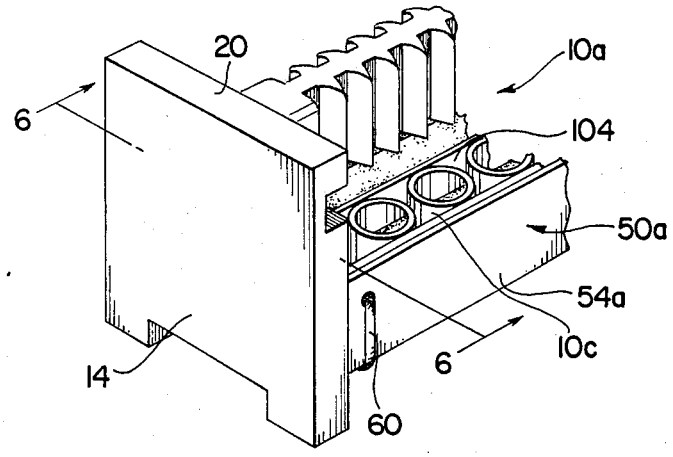
FIG. 5 is a partial perspective view similar to FIG. 1 but showing an alternate embodiment of the test tube rack.
Figure 6:
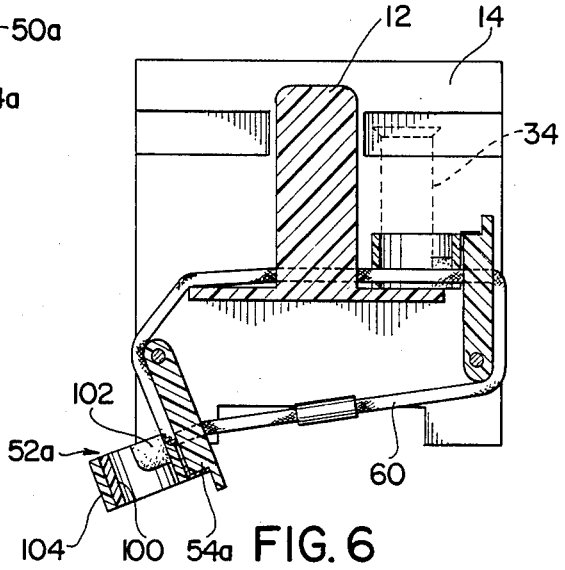
FIG. 6 is a cross-sectional view of FIG. 5 through the rack body.

Turning now to FIGS. 5 through 8 of the drawings, two alternate embodiments of the test tube rack of the present invention are shown. In FIGS. 5 and 6 a construction 10a is shown wherein provision is made for placement of patient specimen tubes adjacent the reagent tubes in a modified form control bar **50*a*, while in FIGS. 7 and 8 a still further form of control bar 50*b*** makes no provision for specimen tubes. Of course, it should be point out that the terms reagent tube and specimen tube in all the embodiments in reality merely refer to different sets of tubes and that it is not necessary to use such tube sets in that way or even for different purposes to practice the invention.

Figure 4:
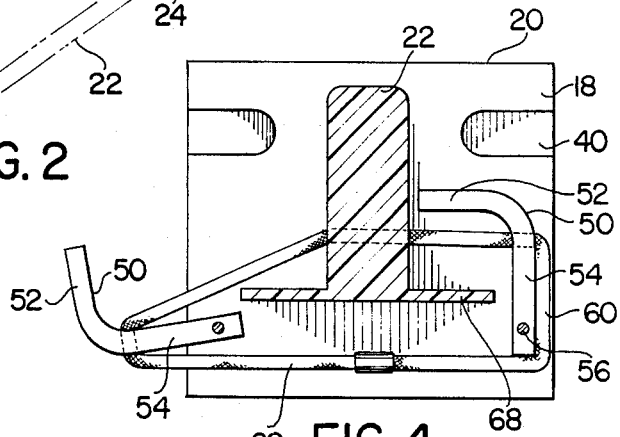
FIG. 4 is a cross-sectional view through the rack body showing the manner in which the control bar is held in both open and closed positions.
Figure 3:
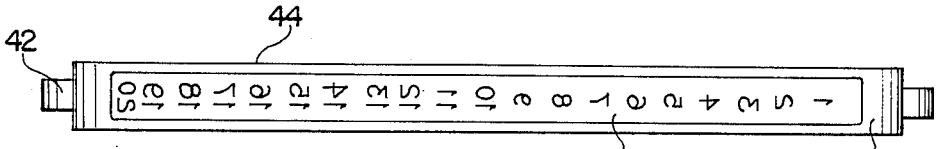
FIG. 3 is a bottom view of a elongated stamp pad that may be utilized for such purpose.

The test tube rack **10*a* is essentially constructed the same as the rack 10 previously described and operates in the same manner except that it includes a control bar 50*a* of modified construction. In that regard, the control bar 50*a* includes a lower surface or plate 54*a* and an upper surface 52*a* connected thereto in a somewhat L-shaped configuration. The upper surface 52*a* includes a series of separate open hoops 100 connected as by screws (not shown) to the interior surface of the plate 54*a*. The hoops extend longitudinally and are each provided with a resilient pad 102 formed of a foam-like, yieldable material such that a patient specimen tube 34 placed therein will be snugly received therein in the desired manner as previously described. The interior portions of the hoops 100 form of themselves an inner edge surface 56*a* or a separate member 104 is attached to the hoops to provide such surface 56*a* such that engagement with the tubes 32 is brought about in the desired manner. Accordingly, the operation of the modified bar 50*a* is essentially the same as previously shown. It should be noted that FIG. 6 shows the bar 50*a* shown on the left depicted in an overcenter open position where the resilient cord 60** partially encircles the plate 54*a* to hold it in that position. The position of the control bar 50 depicted in FIG. 4 is an intermediate open position and its stable position would also be as bar 50*a* is depicted in FIG. 6.

Figure 7:
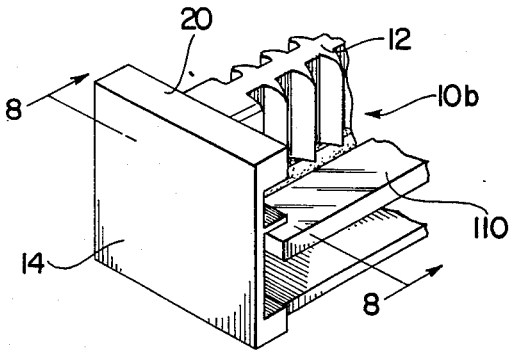
FIG. 7 is a partial perspective view similar to FIG. 1 but showing a still further embodiment of the test tube rack.
Figure 8:
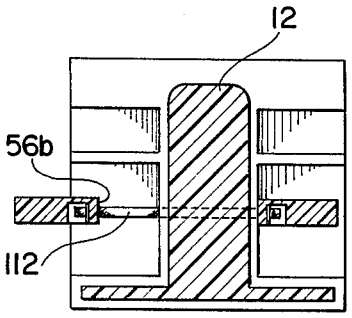
FIG. 8 is a cross-sectional view of FIG. 7 through the rack body.

Turning now to FIGS. 7 and 8, a still further embodiment of a rack 10*b* is shown. Therein a control bar 50*b* in the form of a longitudinally extending inwardly or horizontally disposed member 110 is adapted to move from an inner closed position shown to the right in FIG. 8 to an open position shown on the left in FIG. 8. A resilient shock cord 112 is attached to the opposed members 110 at opposite longitudinal ends thereof such that the members can simply be held open by the operator then allowed to move to the normal closed position where the inner edge surface 56*b* of the member engages the reagent tubes 32 in the desired fashion.

Accordingly, there are first and second horizontal loading positions for the rack of the present invention, and a single upright testing position. Thus a relatively low cost, simply constructed, and highly useful time saving device is provided by the present invention which accomplishes the aforerecited objects thereof.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An improved construction test tube rack usable in alternate horizontal and vertical use positions for respectively initially loading and stamping reaction tubes and thereafter conducting tests from patient specimen tubes in such reaction tubes, comprising a rack body including a pair of end plates each having a lower edge surface forming a first supporting surface for supporting the rack in its vertical position and at least one adjacent side edge surface forming a second supporting surface for supporting said rack in its alternate horizontal position, said body further including a substantially planar tube grid with upper and lower surfaces and longitudinally extending between said end plates and supported thereby, said grid having at least one said surface provided with a plurality of upstanding aligned and longitudinally spaced members for supporting and longitudinally spacing a plurality of reagent test tubes thereon, at least one control bar longitudinally extending along said one grid surface and operable between open and closed alternate positions, said control bar having a substantially transparent inner surface member in opposition to said one grid surface and adapted to contact said reagent test tubes supported thereon in its closed position and positioned away from said one grid surface in its open position, said closed control bar position adapted for use in said vertical rack position to lock said reagent tubes in an upright position.

2. The test tube rack of claim 1, including means for urging said control bar to said closed position.

3. The test tube rack of claim 1, said one grid surface including a longitudinally directed slot extending through said spacing members and a resilient element positioned in said slot and upon which said reagent tubes are adapted to rest for resilient support.

4. The test tube rack of claim 1, wherein both the upper and lower surfaces of said tube grid are provided with said reagent test tube spacing members and said end plates having two side edge surfaces adjacent said lower edge supporting surface for respectively supporting said rack in first and second alternate horizontal positions, there being two control bars each respectively adapted for positioning in an open and closed position.

5. The test tube rack of claim 4, both of said grid surfaces including a longitudinally directed slot extending through said spacing members and a resilient element positioned in said slot and upon which said reagent tubes are adapted to rest for resilient support.

6. An improved construction test tube rack usable in alternate horizontal and vertical use positions for respectively initially loading and stamping reaction tubes and thereafter conducting tests from patient specimen tubes in such reaction tubes, comprising a rack body including a pair of end plates each having a lower edge surface for supporting the rack in its vertical position and at least one adjacent side edge surface for supporting said rack in its alternate horizontal position, said body further including a substantially planar tube grid with upper and lower surfaces and longitudinally extending between said end plates and supported thereby, said grid having at least one said surface provided with a plurality of upstanding aligned and longitudinally spaced members for supporting and longitudinally spacing a plurality of reagent test tubes thereon, at least one control bar longitudinally extending along said one grid surface and operable between open and closed alternate positions, said control bar having an inner surface member in opposition to said one grid surface and adapted to contact said reagent test tubes supported thereon in its closed position and positioned away from said one grid surface in its open position, said closed control bar position adapted for use in said vertical rack position to lock said reagent tubes in an upright position, and wherein both the upper and lower surfaces of said tube grid are provided with said reagent test tube spacing members and said end plates having two side edge surfaces adjacent said lower edge supporting surface for respectively supporting said rack in first and second alternate horizontal positions, there being two control bars each respectively adapted for positioning in an open and closed position, said end plates each having means for receiving and longitudinally orienting an elongated stamp pad in a generally normal attitude above said grid upper and lower surfaces in said alternate first and second horizontal positions for gang stamping indicia upon said reagent test tubes.

7. The test tube rack of claim 6, said end plate stamp pad receiving means being a pair of upright slots in each of the end plate surfaces proximal said tube grid, said slots adapted to receive the outer ends of said stamp pad.

8. The test tube rack of claim 7, including means for resiliently urging said control bar to said closed position.

9. The test tube rack of claim 4, said upper and lower grid surfaces each further including an upright shelf for supporting the ends of said specimen tubes, said shelves positioned below the control bar in said closed position.

10. The test tube rack of claim 1, wherein both the upper and lower surfaces of said tube grid are provided with said reagent test tube spacing members and said end plates having two side edge surfaces adjacent said lower edge supporting surface for respectively supporting said rack in first and second alternate horizontal positions, there being two control bars each respectively adapted for positioning in an open and closed position.

11. An improved construction test tube rack usable in alternate horizontal and vertical use positions for respectively initially loading and stamping reaction tubes and thereafter conducting tests from patient specimen tubes in such reaction tubes, comprising a rack body including a pair of end plates each having a lower edge surface for supporting the rack in its vertical position and at least one adjacent side edge surface for supporting said rack in its alternate horizontal position, said body further including a substantially planar tube grid with upper and lower surfaces and longitudinally extending between said end plates and supported thereby, said grid having at least one said surface provided with a plurality of upstanding aligned and longitudinally spaced members for supporting and longitudinally spacing a plurality of reagent test tubes thereon, at least one control bar longitudinally extending along said one grid surface and operable between open and closed alternate positions and having an upper surface provided with longitudinally spaced openings for receipt of patient specimen tubes, said control bar upper surface terminating in a longitudinal edge proximally spaced to said one grid surface and adapted to contact said reagent test tubes supported thereon in its closed position and positioned away from said one grid surface in its open position, said closed control bar position adapted for use in said vertical rack position to position said specimen tubes adjacent said reagent tubes and to lock said reagent tubes in an upright position, and wherein both the upper and lower surfaces of said tube grid are provided with said reagent test tube spacing members and said end plates having two side edge surfaces adjacent said lower edge supporting surface for respectively supporting said rack in first and second alternate horizontal positions, there being two control bars each respectively adapted for positioning in an open and closed position, said end plates each having means for receiving and longitudinally orienting an elongated stamp pad in a generally normal attitude above said grid upper and lower surfaces in said alternate first and second horizontal positions for gang stamping indicia upon said reagent test tubes.

12. The test tube rack of claim 11, said end plate stamp pad receiving means being a pair of upright slots in each of the end plate surfaces proximal said tube grid, said slots adapted to receive the outer ends of said stamp pad.

13. The test tube rack of claim 12, including means for resiliently urging said control bar to said closed position, said control bars supported for pivotal movement between said open and closed positions and said resilient control bar urging means being an elastic cord at each opposite end of said grid, said cords passing through said grid and both said control bars.

14. The test tube rack of claim 10, said control bars each having a lower extension downwardly extending from said upper surface at a position distal from said grid surfaces, said lower extensions in turn pivotally supported between said end plates.

15. The test tube rack of claim 10, said upper and lower grid surfaces each further including an upright shelf for supporting the ends of said specimen tubes, said shelves positioned below the control bar upper surfaces in said closed position.

16. The test tube rack of claim 14, said control bars being generally of an inverted L shape with the foot of the L forming the upper surface thereof, said upper surfaces being generally planar and provided with said openings for said specimen tubes and said longitudinal edge thereof positioned at a generally normal attitude to said surface proximal thereto.

17. An improved construction test tube rack usable in alternate horizontal and vertical use positions for respectively initially loading and stamping reaction tubes and thereafter conducting tests from patient specimen tubes in such reaction tubes, comprising a rack body including a pair of end plates each having a lower edge surface for supporting the rack in its vertical position and at least one adjacent side edge surface for supporting said rack in its alternate horizontal position, said body further including a substantially planar tube grid with upper and lower surfaces and longitudinally extending between said end plates and supported thereby, said grid having at least one said surface provided with a plurality of upstanding aligned and longitudinally spaced members for supporting and longitudinally spacing a plurality of reagent test tubes thereon, at least one control bar longitudinally extending along said one grid surface and operable between open and closed alternate positions and having an upper surface provided with longitudinally spaced openings for receipt of patient specimen tubes, said control bar upper surface terminating in a longitudinal edge proximally spaced to said one grid surface and adapted to contact said reagent test tubes supported thereon in its closed position and positioned away from said one grid surface in its open position, said closed control bar position adapted for use in said vertical rack position to position said specimen tubes adjacent said reagent tubes and to lock said reagent tubes in an upright position, and wherein both the upper and lower surfaces of said tube grid are provided with said reagent test tube spacing members and said end plates having two side edge surfaces adjacent said lower edge supporting surface for respectively supporting said rack in first and second alternate horizontal positions, there being two control bars each respectively adapted for positioning in an open and closed position, said control bars each having a lower extension downwardly extending from said upper surface at a position distal from said grid surfaces, said lower extensions in turn pivotally supported between said end plates, said upper control bar surface comprising a longitudinally oriented series of rigid, open hoops into which said specimen tubes are adapted to be inserted in upright position, the longitudinal edge of said upper control bar surface being a longitudinal extending upright plate attached to the inner surfaces of said hoops.

18. The test tube rack of claim 17, said hoops attached to the inner surface of said lower extensions.

19. The test tube rack of claim 17, including a resilient pad positioned within each of said hoops to cushion and resiliently engage said patient specimen tubes positioned therein.

20. The test tube rack of claim 1, said control bar having an upper surface provided with longtidunially-spaced openings for receipt of patient specimen tubes, said control bar upper surface terminating in a longitudinal edge approximately spaced to said one grid surface and forming said control bar inner surface member.

* * * * *